US007379684B2

(12) United States Patent
Julien

(10) Patent No.: US 7,379,684 B2
(45) Date of Patent: May 27, 2008

(54) METHOD AND APPARATUS FOR OPTIMIZATION OF SECOND TRANSFER PARAMETERS

(75) Inventor: Paul C Julien, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 210 days.

(21) Appl. No.: 11/428,139

(22) Filed: Jun. 30, 2006

(65) Prior Publication Data

US 2008/0003002 A1 Jan. 3, 2008

(51) Int. Cl.
*G03G 15/00* (2006.01)
*G03G 15/16* (2006.01)

(52) U.S. Cl. ..... 399/49; 399/66

(58) Field of Classification Search ..... 399/49, 399/66

See application file for complete search history.

(56) References Cited

U.S. PATENT DOCUMENTS 4,791,452 A 12/1988 Kasai et al.
4,833,503 A 5/1989 Snelling
4,998,139 A 3/1991 May et al.
5,307,119 A 4/1994 Folkins et al.
6,661,978 B2 * 12/2003 Brewington ..... 399/19
7,054,568 B2 5/2006 Mizes et al.
2005/0265739 A1 * 12/2005 Hamby et al. ..... 399/49

* cited by examiner

*Primary Examiner*—Ryan Gleitz
(74) *Attorney, Agent, or Firm*—Oliff & Berridge PLC

(57) ABSTRACT

Optimization of transfer settings for a given paper and environmental condition is achieved by running a series of prints with varying settings of a transfer parameter such as voltage or current. The mass remaining on the intermediate belt after transfer is monitored for each of the prints. This may be achieved using the same sensor used to monitor and control the developed mass on the intermediate transfer member, such as a transfer belt. A suitable sensor is an Extended Toner Area Coverage (ETAC) mass sensor. Because the control is based on actual conditions for a given paper and environment, it can ensure optimum copy quality over a wide range of papers and conditions, while enabling the minimum target mass per unit area to assure the proper density.

20 Claims, 5 Drawing Sheets

METHOD AND APPARATUS FOR OPTIMIZATION OF SECOND TRANSFER PARAMETERS

BACKGROUND

Many current multi-color image forming devices build up an image on an intermediate and then transfer the color image in one step to paper. The best setting of transfer parameters, such as bias transfer roll voltage and current for the second transfer onto the paper, depends upon many factors, including the specific paper type aid current environmental conditions such as humidity and temperature.

To accommodate this, conventional image forming devices have provided limited adjustments or pre-set configurations that vary the parameters to adapt to certain contemplated conditions. Typically, this is achieved by predefining a limited set of reasonable settings in a look-up table. These are usually based on paper weight and include 3-5 broad categories to accommodate standard paper stock. The table may also be based on environmental conditions, such as high, low or moderate humidity conditions.

Although these procedures are an approximation of existing conditions, there is no guarantee that these will be the optimal settings for a given printing condition or paper stock. Instead, these predefined limited settings can lead to transfer losses of 10% or more.

Other methods and systems are known to control image transfer settings, such as through closed loop control. An example of this is U.S. Pat. No. 7,054,568 to Mizes et al., commonly assigned to Xerox Corporation, which provides a closed-loop control system that uses a full width array (FWA) area coverage sensor to measure residual mass per unit area (RMA) after transfer. Output from the sensor is used as feedback to control subsequent image transfer settings.

Other systems monitor patch density, but are media independent by taking measurements without actual transfer to a specific media type. Thus, they assist in control and formation of toner images on an intermediate transfer member, but do not account for second transfer efficiency, which will vary by transfer media type.

SUMMARY

A single pass, multi-color image forming device has second transfer parameters optimized for current usage conditions, such as paper type and environmental conditions. The optimization is achieved by performing an optimization test procedure prior to printing of a desired image. The test procedure sweeps through a predefined transfer parameter range while developing and transferring a series of test patches onto actual paper of interest. Residual mass is measured for each test patch and the transfer parameter that leads to the minimal remaining mass is used to set optimized transfer parameters.

Current image forming devices that rely on lookup tables for parameter adjustment to accommodate paper type and conditions provide less than optimal results because they are only rough approximations of actual conditions. They also are tailored for only a few basic conventional media types and cannot adapt to new media types or environments. Closed-loop feedback systems may provide improvements, but also may suffer problems as feedback adjustments may have overly narrow adjustability or involve excessive control and complexity.

Thus, there is a need for an image forming device and method that can better optimize operating parameters relating to image transfer from an intermediate member to adapt to or accommodate a wide variety of current conditions and specific image forming media. That is, with ever-increasing need for efficiency and high copy quality there is a need for an image forming device and method that optimizes the transfer efficiency for any paper under any condition.

There also is a need for an image forming device and method that can achieve improved image transfer performance that does not require complex monitoring or control.

Exemplary methods and systems optimize the transfer setting for a given media type and environmental condition in an image forming device by running a series of prints with varying settings of the transfer voltage and monitoring the mass remaining (residual mass) on an intermediate transfer member after second transfer to a specific actual media. The methods are particularly suited for use with multicolor xerographic devices that transfer an image from the intermediate transfer member in a single pass.

In exemplary embodiments, test parameters corresponding to the minimum monitored target mass per unit area are set as optimized parameters for subsequent image transfers to assure the proper density and transfer efficiency for print conditions. In exemplary embodiments, the transfer parameter being optimized includes at least one of transfer voltage and transfer current.

Exemplary methods and systems ensure optimum copy quality over a wide range of media substrates (papers), including new media types, and printing conditions by using actual transfer media and current environmental conditions during the testing.

The monitoring may be achieved using existing hardware and sensors provided to monitor and control the developed mass on the intermediate transfer member. Accordingly, exemplary embodiments do not require additional hardware for implementation.

In exemplary embodiments, the image forming device may be provided with a conventional look-up table for default transfer settings, which can be used for routine printing jobs. However, when desired, such as when using unconventional paper stock or when optimal copy quality is desired, the optimization test procedure may be run to override the default settings.

Although any known or subsequently developed mass sensor may be used, additional advantages may be achieved when an Extended Toner Area Coverage (ETAC) sensor is used, such as the sensor disclosed in commonly assigned U.S. Pat. No. 7,054,568 to Mizes, which is incorporated herein by reference in its entirety.

BRIEF DESCRIPTION OF THE DRAWINGS

Various exemplary details are described with reference to the following figures, wherein.

DETAILED DESCRIPTION OF EMBODIMENTS

Many modern multi-color image firming devices build up an image on an intermediate transfer member and then transfer the color image in one step to a media substrate, such as paper. Such image forming devices include, for example, photocopiers, laser printers, facsimile machines and the like. Examples of these include U.S. Pat. Nos. 4,791,452; 4,998,139; and 4,833,503, the disclosures of which are incorporated herein by reference in their entireties.

These image forming devices employ an imaging member such as a photoreceptor that is electrostatically charged, and then exposed to a light image corresponding to an image to be printed so that the imaging member is selectively discharged in accordance with the image. Thus, exposure of the imaging member records an electrostatic (latent) image on it corresponding to the informational areas contained within the image to be printed. This latent image is developed by bringing a developer material (liquid or powder) into contact with the latent image to form a toner image. The toner image recorded on the imaging member is then transferred to an intermediate transfer member, such as an intermediate belt or drum. The intermediate transfer member is transported past the imaging member to receive the toner image by pressing the intermediate transfer member against the toner image on the imaging member to receive the toner image therefrom. The intermediate transfer member then further transfers the toner image to a receiving material, such as paper.

Figure 1:
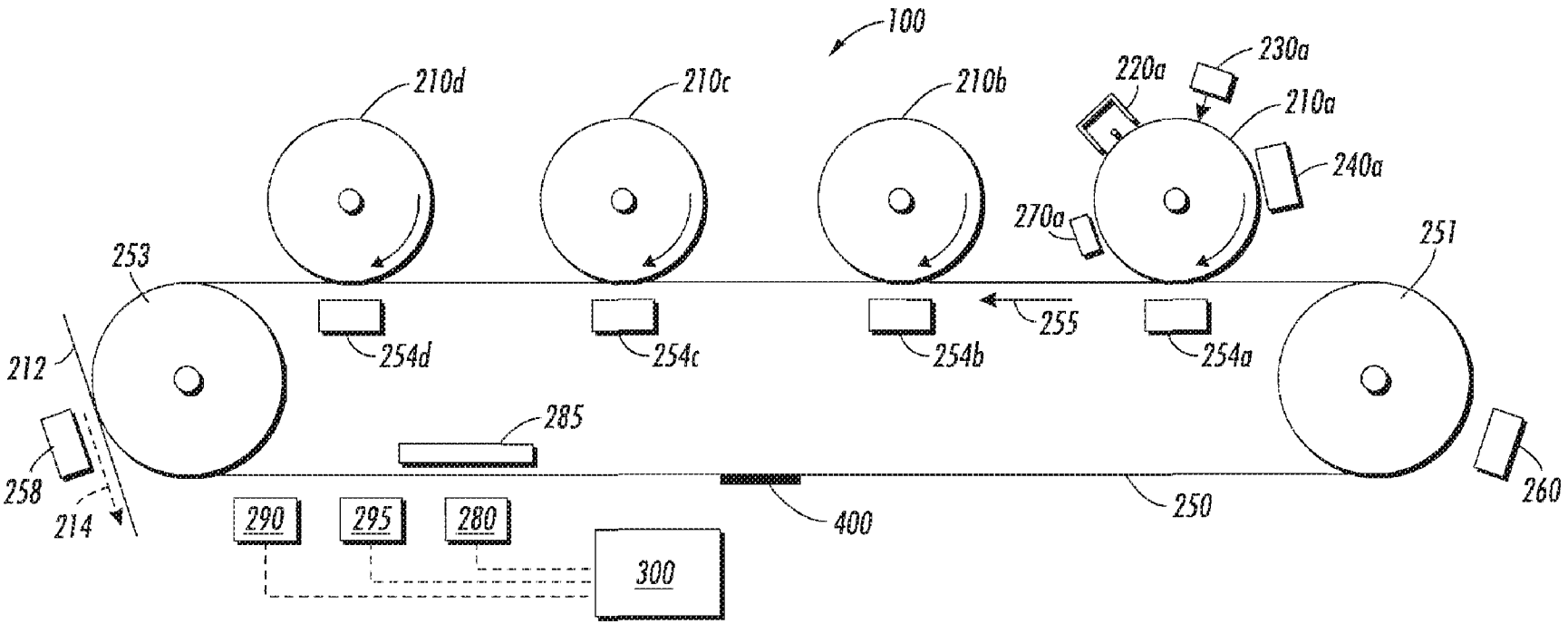
FIG. 1 is a side schematic view of an exemplary four color image forming device having an intermediate transfer member.

An example of this is illustrated in FIG. 1, where a multicolor image forming device 100 has a plurality of print engines arranged in series, each of which transfers a different color toner image of a multicolor image to an intermediate transfer member 250. A first photoreceptor drum 210*a* includes a charging device 220*a*, an exposing device 230*a*, a developer device 240*a* and a cleaning device 270*a* disposed around its periphery. A single color toner image formed on first photoreceptor 210*a* is transferred to intermediate transfer member 250, shown in the form of a transfer belt 250, by first transfer corotron 254*a*. Also, although shown using transfer corotrons 210, alternative transfer mechanisms could be provided, such as known biased transfer rolls. Belt 250 is wrapped around rollers 251, 253 which are driven to move belt 250 in the direction of arrow 255. Second, third and fourth photoreceptors 210*b*, 210*c*, 210*d*, which also include charging, exposing, developing and cleaning devices (not shown) are used to form and then transfer second, third and fourth single-color toner images to belt 250 (on top of each other) using transfer corotrons 254*b*, 254*c*, 254*d*. Typically, these would include separate stages for each of cyan, magenta, yellow and black (CYMK) colorants. Although four stages are shown, fewer or greater stages can be present. For example, as few as two stages could be provided to print black and a highlight color, or six stages could be provided, CYMK colorants plus red and blue colorants.

The multicolor image is then transferred to receiving material 212, such as paper by corotron 258. The paper moves in the direction of arrow 214. Upon completion of transfer, the intermediate belt 250 may pass a cleaning station 260 prior to advancing to photoreceptors 210*a-d* as known in the art.

With the increase in use and flexibility of image forming devices especially color devices which print with two or more different colored toners, it has become increasingly important to monitor the toner development process so that increased print quality, stability and control requirements can be met and maintained. For example, it is very important for each component color of a multicolor image to be stably formed at the correct toner density because any deviation from the correct toner density may be visible in the final composite image. Additionally, deviations from desired toner densities may also cause visible defects in mono-color images, particularly when such images are half-tone images.

Most machines already have a mass sensor looking at the intermediate that is used for determining the mass per unit area transferred to the intermediate belt (TMA or DMA) from the four colors when internally generated patches are created on the photoreceptors for the individual colors and then transferred from the photoreceptor to the intermediate belt. The exposure and development parameters are then adjusted to keep this mass within a target range. For space reasons this sensor is usually located after the area where the image is transferred from the intermediate to paper. Although certain prior applications disabled transfer to allow the undisturbed image to reach the sensor for testing, embodiments enable transfer with the specific paper so readings reflect characteristics of the specific paper being transferred to.

With reference to FIG. 1, suitable sensors 280, 290 and/or 295 are used to measure the mass and/or voltage of a toner patch 400 transferred to belt 250 by each of the four photoreceptors 210*a-d*. Known sensors may include a densitometer, such as an infrared densitometer (IRD) 290, and an electrostatic voltmeter (ESV) 280 (with or without backplate 285) as disclosed in U.S. Pat. No. 5,307,119. More preferably, a suitable sensor would includes an optical Extended Toner Area Coverage (ETAC) sensor 295, which can be either a point sensor or an array sensor, such as disclosed in U.S. Pat. No. 7,054,568.

Known ETAC sensors are based on light scattering or reflecting from the patches on the surface of the intermediate transfer member. These sensors can look at both the specular and diffuse light coming from the patch as it is illuminated by a source. For color images at high density the diffuse image is able to record higher masses without saturating, but the specular signal will be more useful in looking at the low masses typical of the material remaining after transfer. While the light scattering based sensor is most likely to be the type used to measure the mass, this invention is not limited to a particular type of sensor but can be implemented with any type of sensor capable of detecting a small amount of toner on the intermediate.

An advantage of measuring the toner patch density on intermediate transfer belt 250 is that a single densitometer 290 can make a measurement for all colors (i.e., for the color patches formed by each photoreceptor) instead of using a separate mass sensor for each photoreceptor. Although DMA permits one to monitor the manner in which toner is deposited onto the imaging member, it does not provide a complete picture of the image formation process because DMA does not take into account the efficiency with which toner is transferred from the imaging member to the receiving material (e.g., paper) which ultimately receives the final image.

However, the same sensor can be used to look at an image after transfer if the transfer is enabled while the paper of interest is run through the machine. This will measure the extent of residual mass (RMA) remaining on the intermediate transfer member 250. Patches 400 for selected primaries, two color blends, and process black can be generated, developed, transferred to the intermediate. and transferred again to paper. The patches can be set up so that they align with the mass sensor just as the patches for TMA control. This eliminates the need for an additional sensor. Preferably, the patches would be set up so that a complete set fits within the width of a sheet, and transfer settings would be modified or swept between the feeding of each sheet. Thus you would need a number of trial sheets equal to the number of trial transfer settings to perform the testing. After each patch is transferred to the sheet, its RMA would be measured.

These measurements can be used by controller 300 to control various aspects of toner development and the transfer process. This may include, for example, set points for photoreceptor voltage potential, exposure levels, intensity levels, developer biases, developer bias frequency, bias transfer voltages, transfer current, etc.

Figure 2:
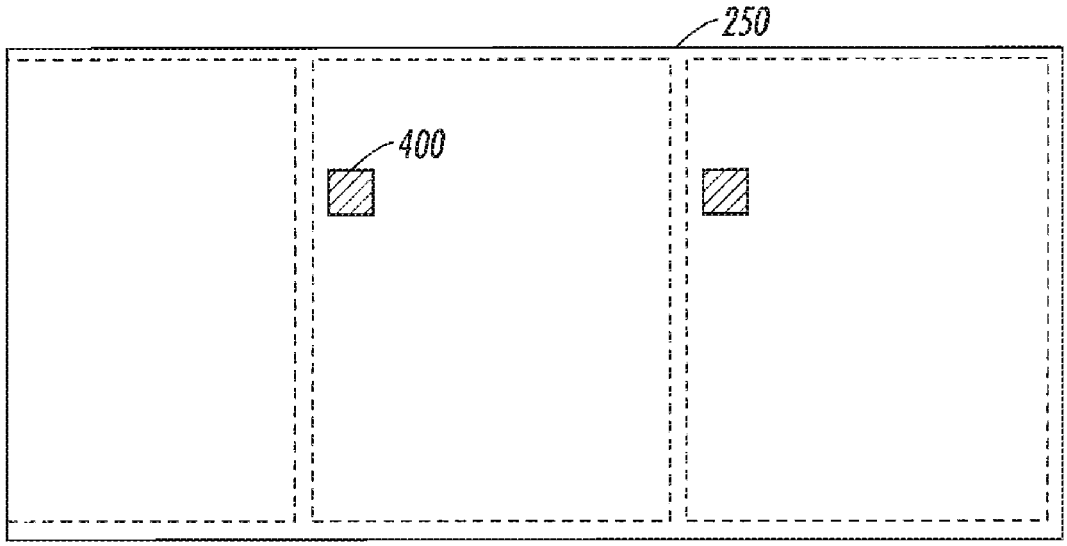
FIG. 2 is a view of the intermediate transfer member of FIG. 1 having exemplary test patches.

FIG. 2 is a view of the intermediate transfer member of FIG. 1 having an exemplary test patch in which the spacing of test patches allows only a single test patch to be transferred to each sheet (the sizing of the sheet being known in outline form).

Figure 3:
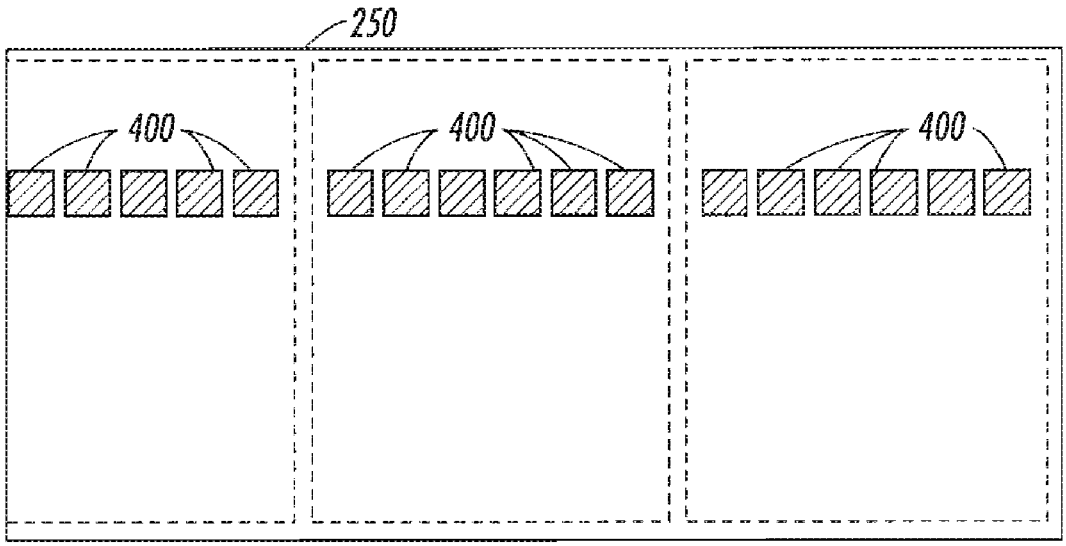
FIG. 3 is a view of the intermediate transfer member of FIG. 1 having different exemplary test patches.

FIG. 3 is a view of the intermediate transfer member of FIG. 1 having exemplary test in which multiple test patches 400 are provided within the interval of a test sheet. This enables multiple test patches to be transferred to a single sheet (the sizing of the sheet being shown in outline form).

The focus of the disclosure is on control and setting of second transfer parameters so that the second transfer is optimized. The best setting of the transfer parameters for the second transfer depends upon many factors, such as paper type and environmental conditions. When the transfer mechanism is a transfer corotron, the transfer parameter may include transfer voltage. When the transfer mechanism is a biased transfer roll, the transfer parameter may include transfer current. Look-up-tables to determine reasonable settings for several broad categories of paper under several humidity conditions typically provide acceptable transfer. However, there is no guarantee that these will be the optimal settings, and they can lead to transfer losses of 10% or more.

Certain image forming devices, such as for example the Xerox 7750 multicolor copier, have a provision for adjusting transfer parameters in a step fashion. Although this particular device only allows manual stepping through parameter settings, embodiments could include software or hardware to automate the stepping through one or more transfer parameter ranges in accordance with the disclosed methods of testing.

The basic testing methodology is to sweep the transfer parameter, such as voltage or current, through a suitable range while a set of patches is developed and transferred to the particular paper of interest. For example, when the transfer mechanism is a corotron, the transfer parameter may be transfer voltage. When the transfer mechanism is a biased transfer roll, the transfer parameter may be transfer voltage. These patches would preferably be aligned with the suitable mass sensor and the parameter leading to minimum mass remaining on the intermediate member (and hence maximum transfer efficiency) is determined. Data may be generated with one, two, or more toner layers and a suitable weighed average may be used to determine the optimum setting.

In the case of the 7750 copier, nine setting adjustments are possible. When a single test patch is printed oil each sheet, this would result in a waste of nine sheets of paper to perform the testing and find an optimal setting. To save paper, possibly more than one set of patches could be fit within one sheet of paper as in FIG. 3.

Because there is a cost to the process, an operator may only want to run the optimization when he intends to run the one paper for a long job or for several jobs in sequence. Also, the knowledge of current environmental conditions could be used to establish a range of settings to optimize over. For example, the highest five settings out of nine could be examined at low humidity and the lowest five settings could be examined at high humidity. Thus, it is advantageous to provide an image forming system that is capable of default operation for routine jobs, but has the capability of optimization if desired.

Figure 4:
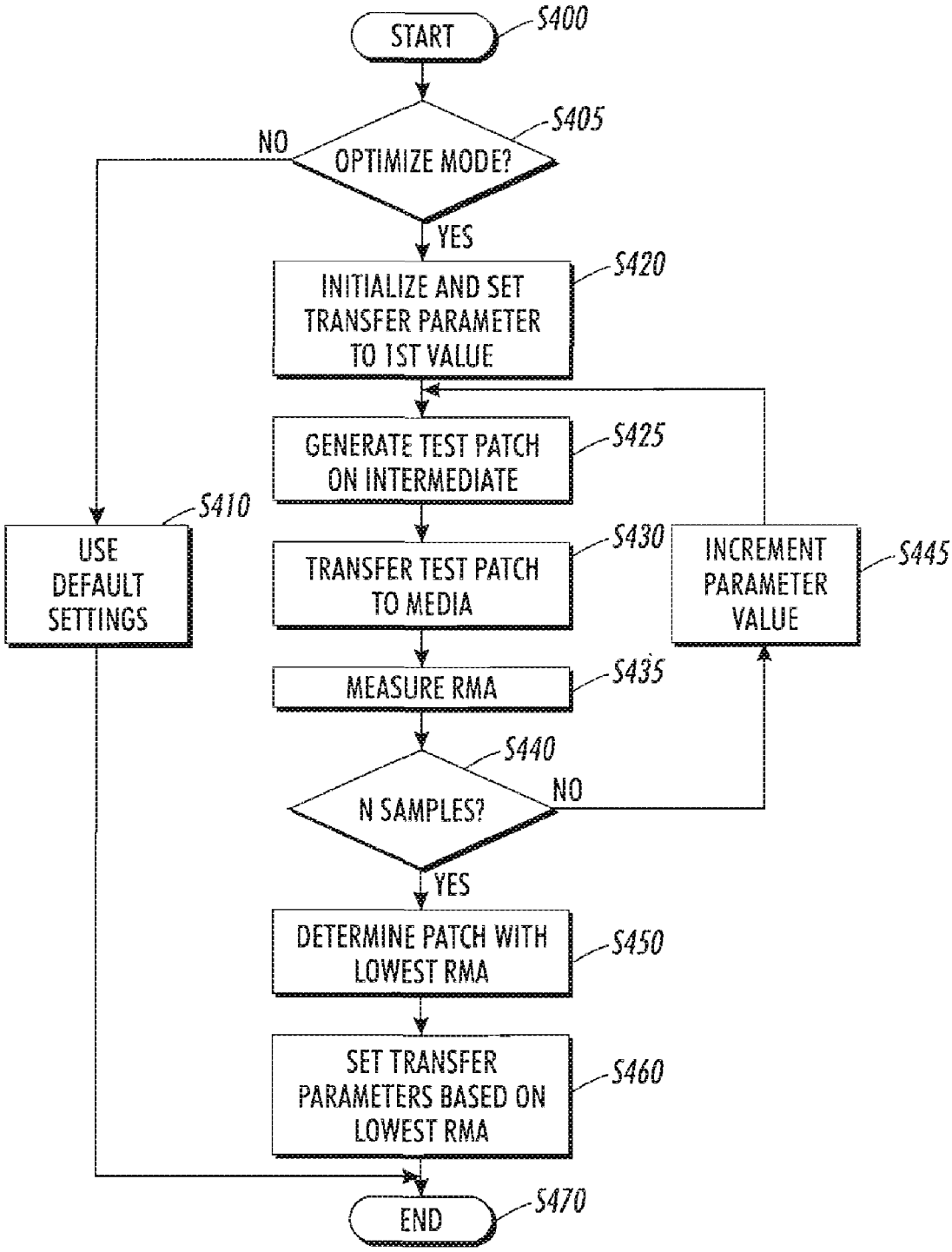
FIG. 4 is a flow chart showing an exemplary method for optimizing transfer parameters.

An exemplary process for optimizing the second transfer will be described with reference to FIG. 4 and may use the image forming device of FIG. 1. The process starts at step S400 and advances to step S405 where it is determined whether an optimization mode is set. An advantage of this is that the image forming apparatus can operate in a default mode in which standard settings can be set and maintained. For example, if the image forming apparatus incorporates a lookup table, such as in a Xerox 7750 multicolor copier, the copier is able to operate in a default mode using the predefined values unless it is desirable to achieve optimized or customized settings. This may be, for example, when an important copy job is received requiring higher than average quality, or when using specialty media or operating is non-typical environmental conditions.

If the optimization mode is not set, flow advances to step S410 where default settings are used and the process is ended. However, if the optimization mode is set, flow advances from step S405 to step S420 where initialization occurs. This resets the current image transfer settings and sets one or more transfer parameters to a first value. Initialization may also include setting of a sampling rate N relating to the number of test samples and values to sweep through. Thus, N defines the sampling granularity of the testing. That is, the test parameter is varied from a lowest to a highest operating value, with a higher sampling rate resulting in a smaller incremental advance between each sampling. A sampling with N=3 would result in a low, a middle and a high value, whereas a sampling with N=9 would have the operating range divided into nine sampled values, with nine sheets of paper needed to find the optimum setting.

Although N could take any value, there is a tradeoff between optimization and efficiency. Because there is a cost and time associated with the process, an operator may select the level of optimization needed. For most purposes, a suitable N would be between 5-9 to attain a substantially optimized transfer setting. After that, there are diminishing returns, particularly when assessing multicolor print patches. To save paper, possibly more than one set of patches can be fit within one sheet of paper (as shown in FIG. 3). However, this would require a faster sweep of values or a slowing down of the transfer process.

Also, the knowledge of the environmental conditions being experienced now can be used to determine the transfer setting range to be varied. For example, in a system where the parameter can be varied between 9 values, the highest five settings out of nine can be examined at low humidity and the lowest five settings can be examined at high humidity.

Once the parameters are initialized, flow advances to step S425 where a test patch is generated on the intermediate member as known in the art. For example, the intermediate member 250 may include one test patch 400 at page width intervals as in FIG. 2 so each test patch is transferred to a different sheet. This allows sufficient time between test patches to adjust the transfer parameter to the next incremental value. Alternatively the interval between test patches can be reduced so that more than one test patch is transferred to each paper sheet as in FIG. 3.

From step S425, flow advances to step S430 where the test patch 400 is transferred from the intermediate transfer member to the media, such as a desired sheet of paper of any suitable type, as known in the art. Once test patch 400 is transferred, flow advances to step S435 where the residual mass of toner (RMA) on the intermediate member 250 in the test patch area is measured. Measurement can take various conventional or subsequently developed forms. Preferred embodiments rely on existing mass sensors provided on the image forming device to eliminate the need for additional sensors. Although simpler mass sensors could be used, preferred embodiments use an ETAC sensor, which provides a higher degree of accuracy. However, the invention is equally applicable to other methods such as vacuuming of the residuals from the intermediate member 250 for remote mass measurement using a scale.

From, step S435, flow advances to step S440 where it is determined whether additional samples are necessary. If so, flow advances to step S445 where the parameter value is incremented. From step S445, flow returns to step S425 where another test patch is generated.

If no further test samples are necessary, flow proceeds from step S440 to step S450 where a determination is made of the patch having the lowest RMA. When the transfer involves multiple color transfers, it may be desirable to determine the RMA of each individual color. Because each color could have differing transfer properties, the patch corresponding to the lowest RMA would be chosen based on an combination of color values and an associated weighting to achieve a composite optimization.

From step S450, flow advances to step S460 where the image forming apparatus transfer parameters are set based on the determined lowest RMA. For example, if there were nine test patches and the third patch had the lowest RMA, the transfer parameters would be set to the values used to generate the third test patch. From step S460, flow advances to step S470 where the process stops.

As is evident from the above discussions, this method is capable of optimizing transfer parameters without the need for any additional hardware, such as sensors, as it uses hardware already provided for other purposes. What is needed is the ability to controllably adjust one or more operating parameters relating to the transfer to sweep the parameter through several values within an operating range of values.

Figure 5:
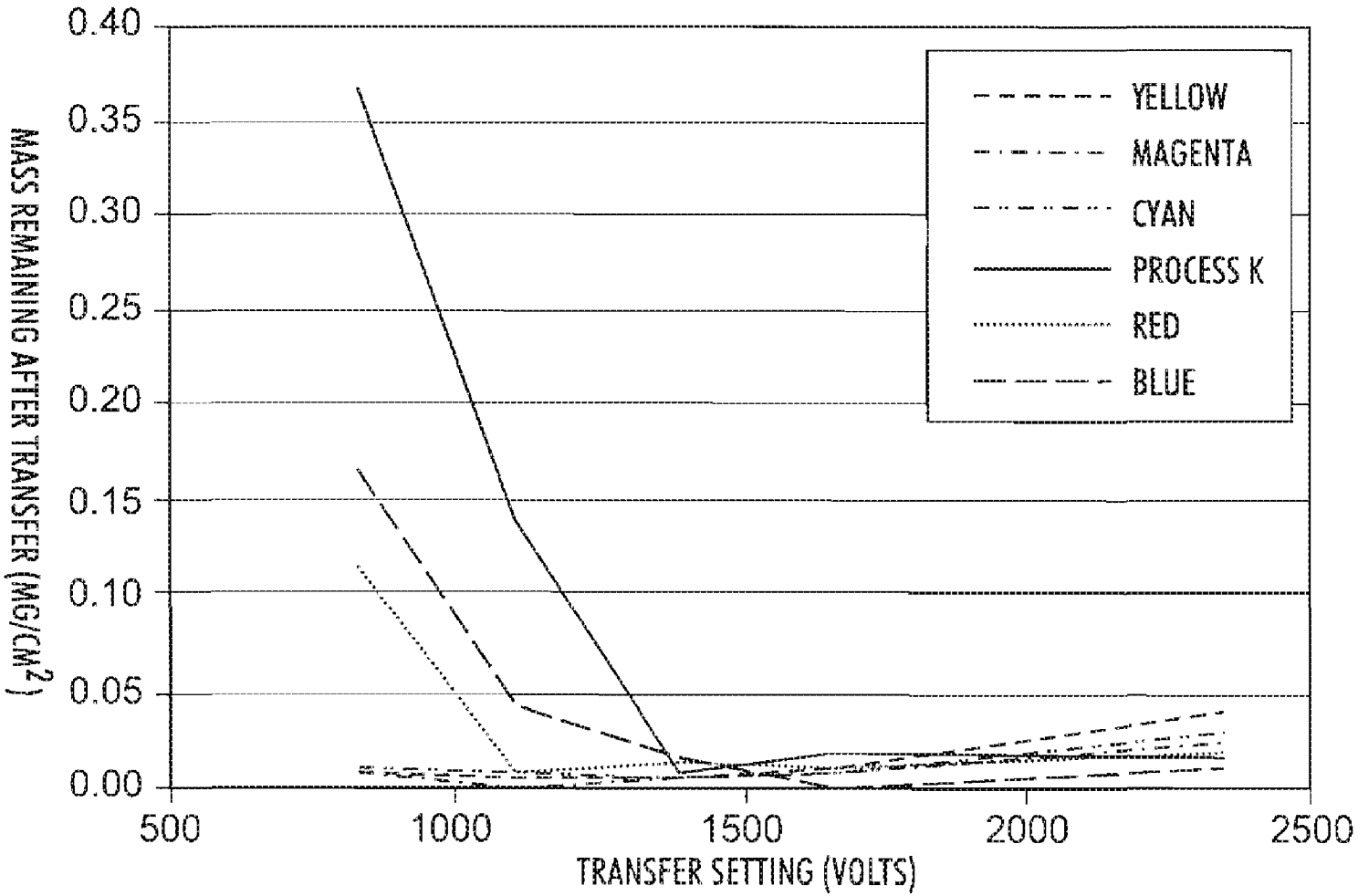
FIG. 5 is a chart showing second transfer sensitivity for each of several colors as measured by residual mass.
Figure 6:
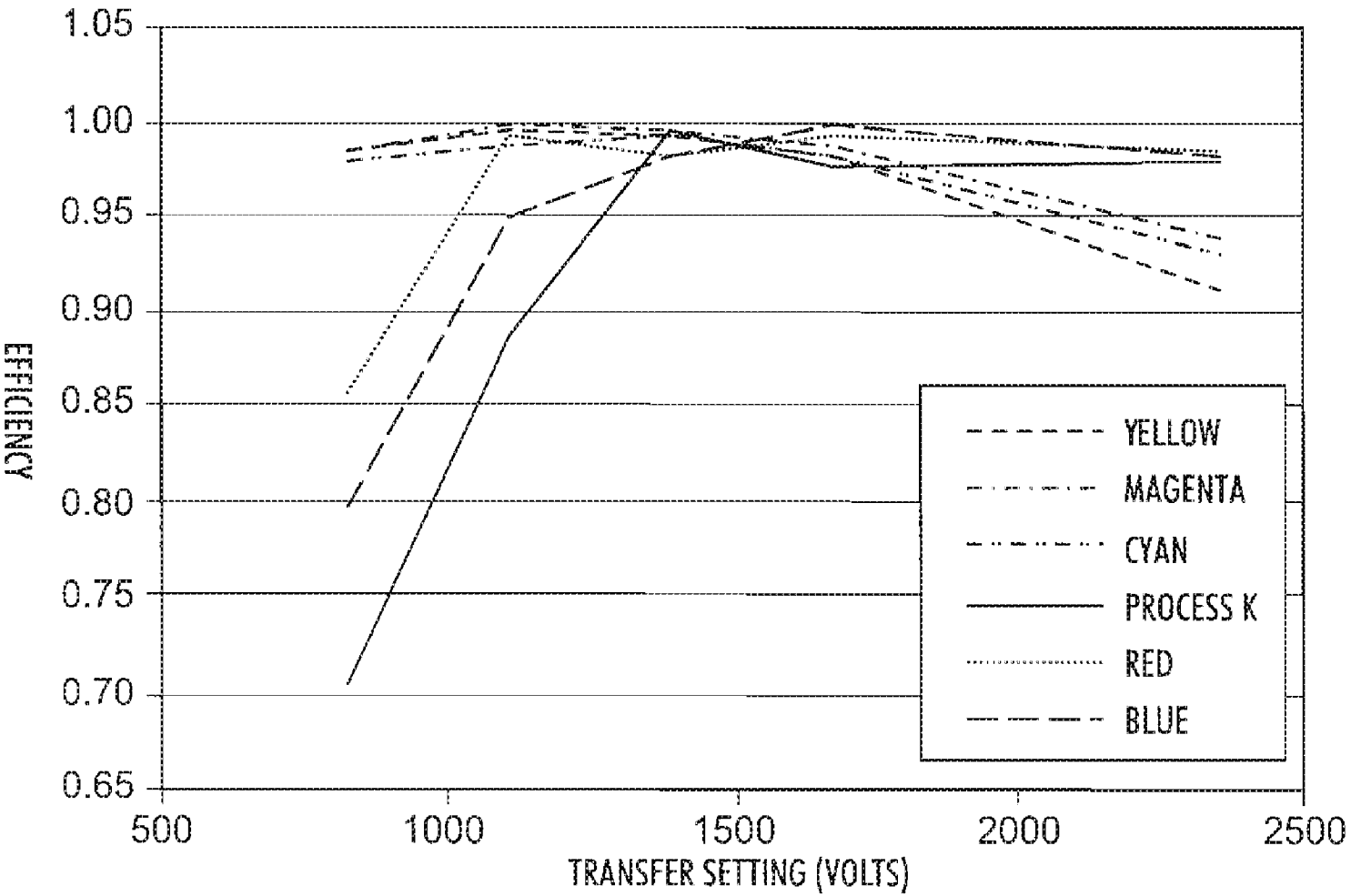
FIG. 6 is a chart showing second transfer sensitivity for each of several colors as measured by efficiency.

FIGS. 5 and 6 show the transfer performance of an exemplary test conducted on a Xerox 7750 copier using 120 gsm Digital Color Gloss coated paper and ambient conditions (70° F. 70% RH). FIG. 5 expresses the results as the mass remaining on the intermediate member after transfer form each individual color of the image and FIG. 6 expresses the results in terms of transfer efficiency for the different colors. At a nominal value for the transfer voltage (determined by the look-up-table) of 2350 volts on single layer samples (CMY) there is some air breakdown, leading to transfer efficiencies between 90 and 95%. The transfer efficiency can be raised to almost 100% by lowering the voltage, but below 1400 volts the electric field is not high enough to transfer all the layers, and so the transfer efficiency drops off dramatically. In this particular example, at around 1500 volts, both single and multiple layers are transferred at high efficiency. This would be an optimal setting for this particular paper under the existing environmental conditions. Analysis of the RMA (FIG. 5) similarly shows that values between 1400V and 2000V result in reduced mass.

As shown by the graphs in FIGS. 5-6, each color component may act differently. Accordingly, when optimizing color printing, it may be necessary to assign weighted averages to derive a value that achieves the best results for the overall image.

Just as another detector can be used to look at RMA, if a corotron or other device is used to transfer toner to paper, parameters relating to their operation could also be adjusted on the basis of the RMA to optimize transfer for a given paper type.

It will be appreciated that various of the above-disclosed and other features and functions, or alternatives thereof, nay be desirably combined into many other different systems or applications. For example, the test patches 400 may provide single color residual mass for testing or multiple layers for testing. Also, various presently unforeseen or unanticipated alternatives, modifications, variations or improvements therein may be subsequently made by those skilled in the art, and are also intended to be encompassed by the following claims.

What is claimed is:

1. A method of optimizing transfer efficiency to any media in an image forming device having an intermediate transfer member, comprising:

initializing transfer parameters for the intermediate transfer member to a first value;

sweeping parameter values from the first value to a different second value;

generating a series of test patches on the intermediate transfer member, at least one test patch for each different parameter value;

transferring the series of test patches from the intermediate transfer member to a desired media;

measuring residual mass (RMA) remaining on the intermediate transfer member from the series of test patches after transfer of the patches;

determining a patch of the series of patches having the lowest RMA; and setting at least one transfer parameter based on the determination to adjust the transfer parameter for the desired media.

2. The method according to claim 1, wherein the image forming device is a xerographic device.

3. The method according to claim 1, wherein the at least one parameter includes either a transfer voltage or a transfer current applied to the intermediate transfer member to achieve the transfer.

4. The method according to claim 1, wherein the measurement is achieved using a mass sensor.

5. The method according to claim 4, wherein the mass sensor is an Extended Toner Area Coverage (ETAC) sensor.

6. The method according to claim 1, wherein each of the series of test patches is transferred to a separate media sheet.

7. The method according to claim 1, wherein the sensor is one of a point sensor and an array sensor.

8. The method according to claim 1, wherein the image forming device is a multiple color image forming device and the series of test patches include both single color layers and layers of more than one color.

9. The method according to claim 1, wherein the number of test patches is sufficiently large to distinguish an optimal transfer parameter to maximize transfer efficiency for any type of media.

10. The method according to claim 9, wherein the number of patches is between about 5-9.

11. An image forming device that can set an optimal transfer parameter for any specific media type based on actual media type and environmental conditions, comprising:

an intermediate transfer member;

a test patch generator that provides a series of test patches formed from a toner layer of at least one color onto the intermediate transfer member;

a transfer mechanism for transferring the toner layer onto another media, the transfer mechanism having at least one transfer parameter that can be adjusted within a range of values;

at least one mass sensor that senses residual toner mass on the intermediate transfer member after transfer of the series of test patches from the intermediate transfer member;

a controller for sweeping the at least one transfer parameter through at least part of the range of values;

means for determining the test patch of the series of test patches that has the lowest residual mass; and a controller for setting at least one of the transfer parameters in accordance with the determination to adjust transfer efficiency for the particular media tested.

12. The image forming device according to claim 11, wherein the image forming device is a xerographic device.

13. The image forming device according to claim 11, wherein the at least one parameter includes either a transfer voltage or a transfer current applied to the intermediate transfer member to achieve the transfer.

14. The image forming device according to claim 11, wherein the mass sensor is an Extended Toner Area Coverage (ETAC) sensor.

15. The image forming device according to claim 11, wherein the sensor is one of a point sensor and an array sensor.

16. The image foxing device according to claim 11, wherein the image forming device is a multiple color image forming device and the series of test patches include both single color layers and layers of more than one color.

17. The image forming device according to claim 11, wherein the number of test patches is sufficiently large to distinguish an optimal transfer parameter to maximize transfer efficiency for any type of media.

18. The image forming device according to claim 17, wherein the number of patches is between about 5-9.

19. The image forming device according to claim 11, further comprising a default transfer parameter set for a particular classification of media types, wherein the image forming device can be set to override the default parameter settings to perform transfer optimization for a specific media type.

20. The image forming device according to claim 19, wherein the default transfer parameter is set in a lookup table for a finite set of predefined media classifications.

* * * * *